US009285118B2

(12) United States Patent
Neufeldt et al.

(10) Patent No.: US 9,285,118 B2
(45) Date of Patent: Mar. 15, 2016

(54) PROPANE VAPORIZER FOR FUEL POWERED DEVICES

(71) Applicants: Allen A. Neufeldt, Toronto (CA); Ian Widgett, Toronto (CA)

(72) Inventors: Allen A. Neufeldt, Toronto (CA); Ian Widgett, Toronto (CA)

( * ) Notice: Subject to any disclaimer, the term of this patent is extended or adjusted under 35 U.S.C. 154(b) by 0 days.

(21) Appl. No.: 14/807,709

(22) Filed: Jul. 23, 2015

(65) Prior Publication Data

US 2015/0330627 A1 Nov. 19, 2015

Related U.S. Application Data

(63) Continuation-in-part of application No. 10/166,754, filed on Jun. 12, 2002, now Pat. No. 6,755,643.

(51) Int. Cl.

| | |
|---|---|
| ***F23K 5/22*** | (2006.01) |
| ***F23D 11/44*** | (2006.01) |
| ***F23K 5/20*** | (2006.01) |

(52) U.S. Cl.

CPC ..... *F23K 5/22* (2013.01); *F23D 11/441* (2013.01); *F23D 11/445* (2013.01); *F23K 5/20* (2013.01)

(58) Field of Classification Search

CPC ..... F23K 5/22; F23K 5/20; F23D 11/441; F23D 11/445; F17C 9/02; F17C 2227/0393; F17C 2221/033; F28C 3/06

See application file for complete search history.

(56) References Cited

U.S. PATENT DOCUMENTS

| | | | | |
|---|---|---|---|---|
| 3,212,567 | A * | 10/1965 | Romanos | F28D 7/06 165/162 |
| 3,897,194 | A | 7/1975 | Von Wiesenthal | |
| 4,008,041 | A | 2/1977 | Roffe et al. | |
| 5,611,366 | A | 3/1997 | Creffield et al. | |
| 6,755,643 | B2 * | 6/2004 | Neufeldt | F23K 5/20 431/11 |

* cited by examiner

*Primary Examiner* — Alfred Basichas

(74) *Attorney, Agent, or Firm* — Nasser Ashgriz; Uipatent Inc.

(57) ABSTRACT

The present invention is a device that supplies the latent heat for vaporization of L.P. gases. The device for a supply of fuel vapor to a fuel powered device, comprising of a supply tank; a liquid bath having a temperature control system; a LPG flow line immersed inside the liquid bath; a heating system to heat the LPG; and a vaporizer control system comprising a temperature sensor to measure the temperature of the liquid bath, the temperature sensor is connected to a solenoid valve in the vapor supply line, and wherein said temperature sensor shutting off the solenoid valve when the bath temperature drops below a predetermined temperature.

9 Claims, 4 Drawing Sheets

PROPANE VAPORIZER FOR FUEL POWERED DEVICES

RELATED APPLICATION

This application repeats a substantial portion of prior application Ser. No. 10/166,754, filed Jun. 12, 2002, and adds and claims additional disclosure not presented in the prior application. Since this application names the inventor or at least one joint inventor named in the prior application, it may constitute a continuation-in-part of the prior application.

FIELD OF THE INVENTION

This invention relates to a vaporizer to vaporize liquid petroleum gas. More particularly, this invention relates to a vaporizer having a temperature controller for safe operation of the vaporizer.

BACKGROUND OF THE INVENTION

U.S. Pat. No. 6,755,643 by the present inventor introduced a vaporizer for liquid petroleum gas (LPG). The vaporizer has a helical coil with an inlet and an outlet. The inlet of the coil is connected to the supply of liquid petroleum gas. The coil is located within a housing containing a bath and it is completely immersed in the bath liquid. A gas-heater is used to heat the bath liquid and the LPG. The LPG is substantially vaporized while inside the coil. The outlet of the coil is connected to a fuel powered device. A set of control means control the flow of petroleum gas from the supply through the coil to the fuel powered device. In the U.S. Pat. No. 6,755,643, if the fuel powered device requires more vapor than the vaporizer is able to produce, the temperature of the vapor will decrease and a temperature sensor which is located at the out of the vaporizer to measure the temperature of the LPG gas will shut off the flow valves in the system.

The present vaporizer has a novel method of controlling the operation of the vaporizer. The new control system is based on liquid bath temperature, rather than the LPG vapor temperature of the prior art. This new method provides a much safer vaporizer.

SUMMARY OF THE INVENTION

The present invention is an improvement over a liquid petroleum (LPG) gas vaporizer provided by the same inventor and disclosed in U.S. Pat. No. 6,755,643. The vaporizes comprises of a liquid petroleum gas (LPG) supply tank, a liquid LPG supply line having a first solenoid valve, a liquid bath having a temperature control system, a LPG flow coil immersed inside said liquid bath, said coil having and inlet and an outlet, a burner to heat the liquid bath, a vapor LPG supply line having a second solenoid valve. The liquid supply line is connected to the inlet of the coil and the vapor supply line is connected to the outlet of the coil, thereby supplying vapor to a fuel powered device. The present vaporizer having a temperature sensor switch to measure the temperature of the liquid bath. The temperature sensor is connected to the second solenoid valve in the vapor line. This temperature sensor controls the operation of the vaporizer. The temperature sensor shuts off the second solenoid valve when the bath temperature drops below a predetermined operation temperature.

The control mechanism for the flow of LPG is critical in the safer operation of these types of vaporizers. In the prior art, the control was based on the temperature of LPG vapor leaving the bath. Whereas, in the present device, the control is based on the temperature of the water bath, which senses the temperature drop in a water bath sooner than sensing vapor at outlet.

It is an object of the present invention to provide a vaporizer that vaporizes liquid petroleum gas to vapor at a predefined temperature and pressure.

It is another object of the present invention to provide a vaporizer that operates the heating system at low pressures.

It is a further object of the present invention to provide a vaporizer that vaporizes liquid petroleum gas from a high pressure supply and is suitable for operation on a small scale or large scale.

It is another object of the present invention to have a better control on the vaporization process of the liquid petroleum gas.

It is another object of the present vaporizer to have a more efficient heat transfer system between the hot flue gases and the bath liquid.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DESCRIPTION OF A PREFERRED EMBODIMENT

Figure 1:
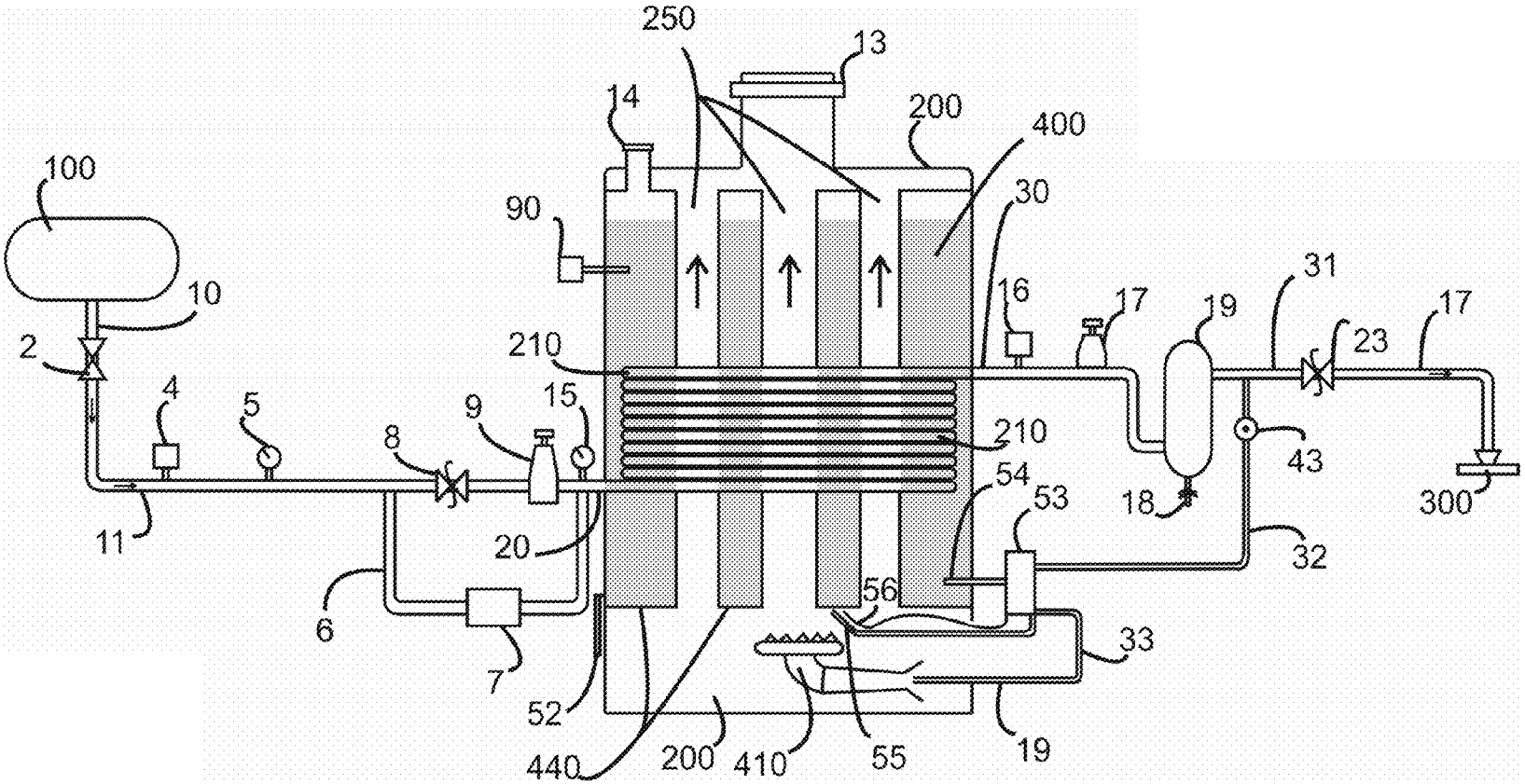
FIG. 1 is a schematic side view of the vaporizer of the present invention.

FIG. 1 illustrates the present vaporizer. The liquid petroleum gas (LPG) flows from a fuel tank (60° F., pressure: 100 psig) 100 through a supply line 10 to a vaporizer 200. A vaporized LPG leaves the vaporizer to a gas burning equipment 300. The liquid petroleum gas is heated inside a temperature controlled heat exchanger liquid bath 400. The LPG enters the bath at 20 and vapor leave the bath at 30. A coil type heat exchanger 210 is used to provide a required heat for the latent heat of vaporization. The entire coil 210 is immersed inside the water bath 400.

Figure 3:
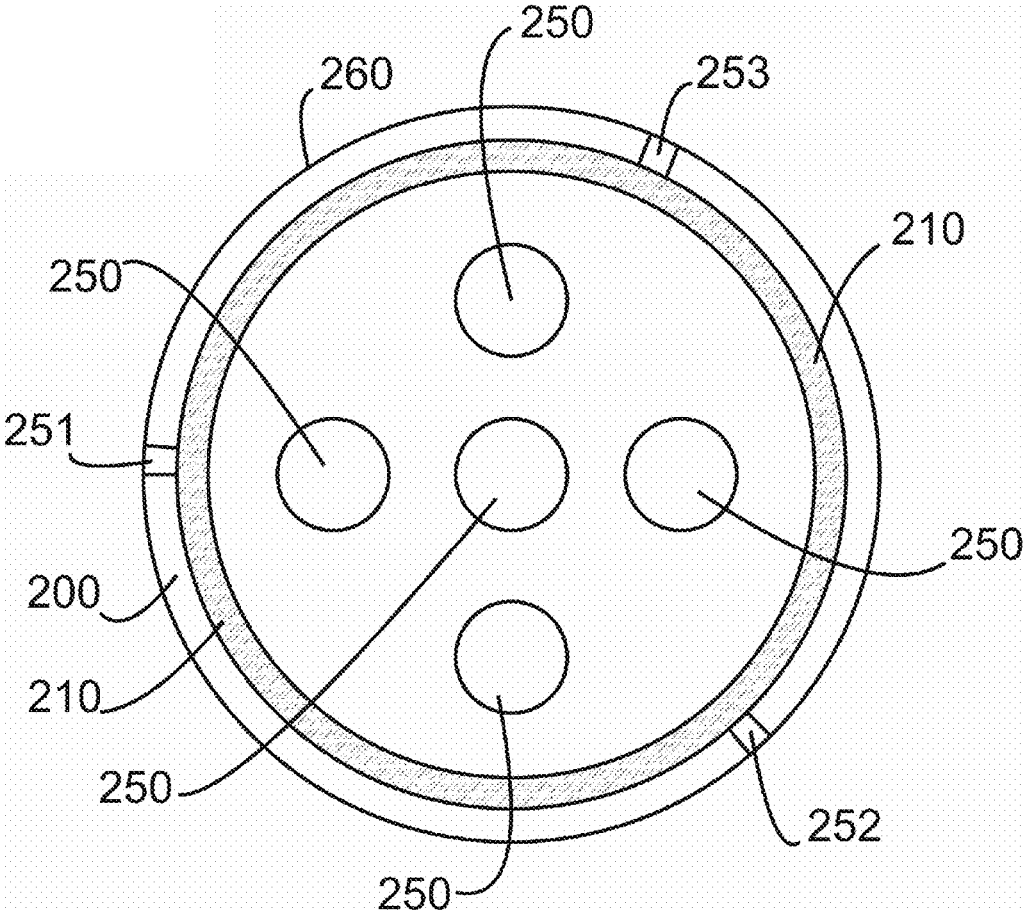
FIG. 3 is a top view of the coil holder of the present invention.
Figure 4:
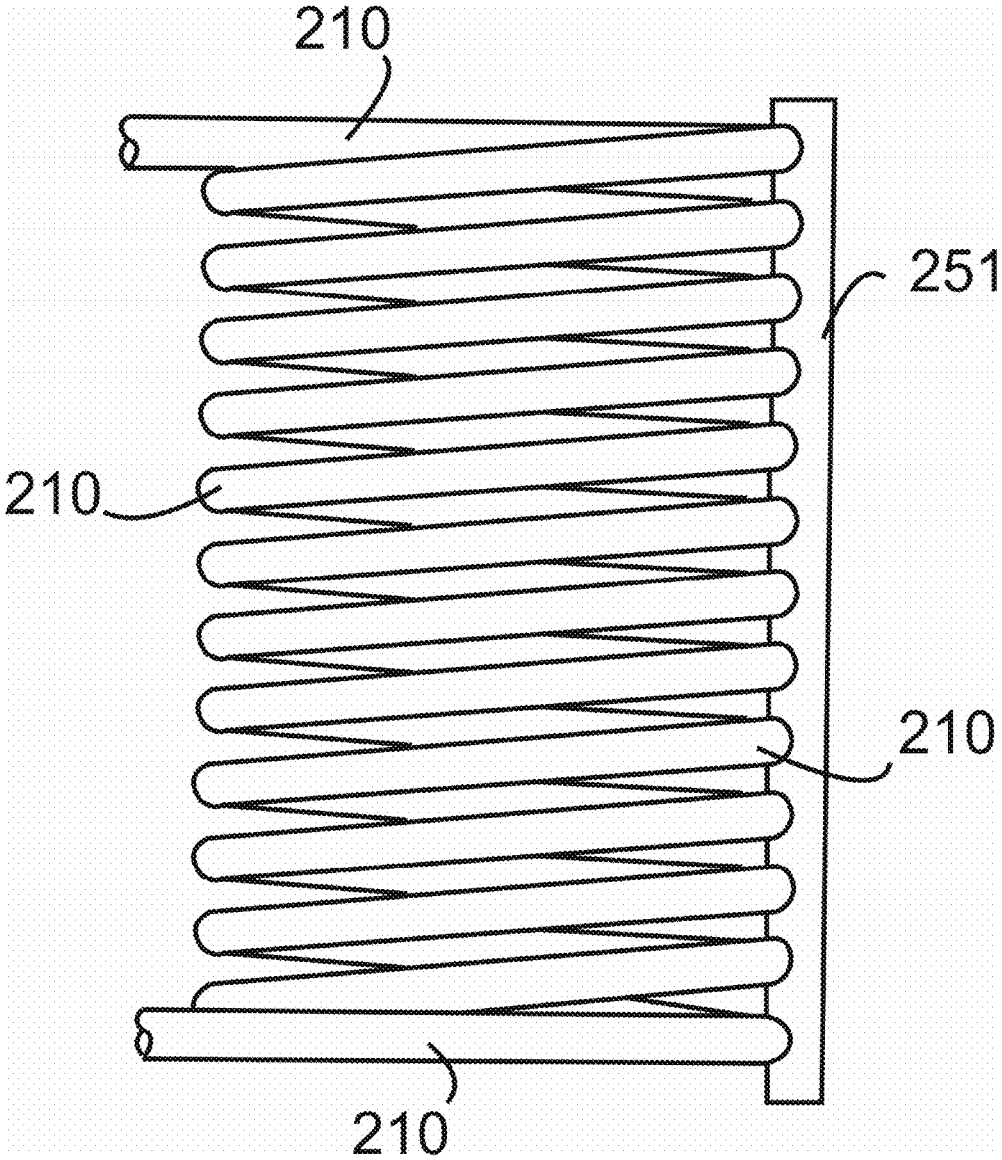
FIG. 4 is a side view of the coil holder of the present invention.

Since the vaporizer may be installed on a moving vehicle, it may be shaking and vibrating. In particular, since the LPG is carried in a coiled line 210, the coil can be easily vibrated. Continuous shaking and vibration of the LPG line may result in fatigue and formation of cracks in the line. In order to reduce system vibration, the LPG coil 210 is supported by fixed structures 251-253 as shown in FIGS. 3 and 4. The fixed structure comprises of sectional elements, 251, 252, and 253 that hold the coil from one side and are flatly held by the vessel walls 260. The coil 210 is first rapped inside the sectional fixture 251-253, and the combination of coil and structure are inserted into the cylindrical vessel 200.

The water bath has a temperature switch 90 which prevents starting the gas burning equipment 300 until the water bath 400 has reached the operating temperature. This is the main element of the present invention. Controlling the flow of LPG based on the water bath temperature provides for a safe operation of the vaporizer under a variety of operational scenarios as it will be discussed later.

The vaporizer of the present invention comprises of (i) a liquid LPG supply line, (ii) a heating system, (iii) a vapor LPG supply line, and (iv) a control system.

The Supply Line: The supply line 10 comprises of a shut off valve 2, a hydrostatic relief valve 4, a pressure gage 5, a first solenoid valve 8, a high pressure regulator 9 for liquid the LPG before it enters the vaporizer and a pressure gage 15 downstream of the regulator 9. A bypass lines 6 going around the first solenoid valve 8 and regulator 9 to return the flow from the downstream of the pressure regulator 9 to upstream of the solenoid valve 8. The by-pass line has a check valve 7 that prevents the liquid petroleum from by-passing the solenoid valve 8 and high pressure regulator 9. When the vaporizer is shut off, the liquid LPG from the coil is trapped and flows back into the supply tank through the bypass line 6 and check valve 7. The valve 2 should be open during operation and for safety purposes, it is important to have the valve open to let trapped gas turn back to the tank.

The Heating System: The heating system comprises of a water bath 400 that is heated by a gas burner 410 and a vaporizing coil 210, which is immersed inside the water bath 400. The bath water is preferably mixture of propylene glycol or ethylene glycol diluted with water (e.g., an anti-freeze liquid).

The gas burner receives its gas supply from the vaporizer outlet 31, and through secondary lines 32 and 33. The secondary line 32 has a low pressure regulator 43 to reduce the pressure of vaporized fuel through the secondary line 32 to a temperature controller 53. The controller 53 has a temperature probe 54 extending through the walls of the vaporizer 200 and into the bath 400. The temperature controller 53 controls the flow of gas to a pilot light 55 having a thermocouple 56. The temperature controller 53 is connected to a burner line 33, which in turn is connected to the burner 410. The burner is preferably located within the vaporizer housing 200, but is separated from the bath 400 by walls 440. The vaporizer has several flues for the hot gas to pass through the water bath. In the embodiment illustrated in FIG. 1, the vaporizer has 5 flue lines 250. At the top of the flue there is a vent hood 13. The housing 200 contains a fill opening 14.

The burner 410 is designed to maintain the temperature of the bath 400 within a predetermined range. When the temperature probe indicates that the bath is at the maximum end of the range, the burner automatically shuts off. When the probe indicates that the temperature of the bath is at the minimum end of the range, the burner turns on. That cycle is repeated as required. The fuel supplying the burner is part of the vaporized liquid petroleum gas being produced by the vaporizer. However, the burner could be supplied by a separate fuel supply, separate and apart from the fuel supply of the vaporizer.

Vapor Outline Line: The vapor formed in the vaporizer exits the bath at an outlet 30 and passes through a second pressure regulator 17, which is a vapor pressure regulator. The vapor L.P. gas then flows into an oil trap 19 with a drain 18.

Figure 2:
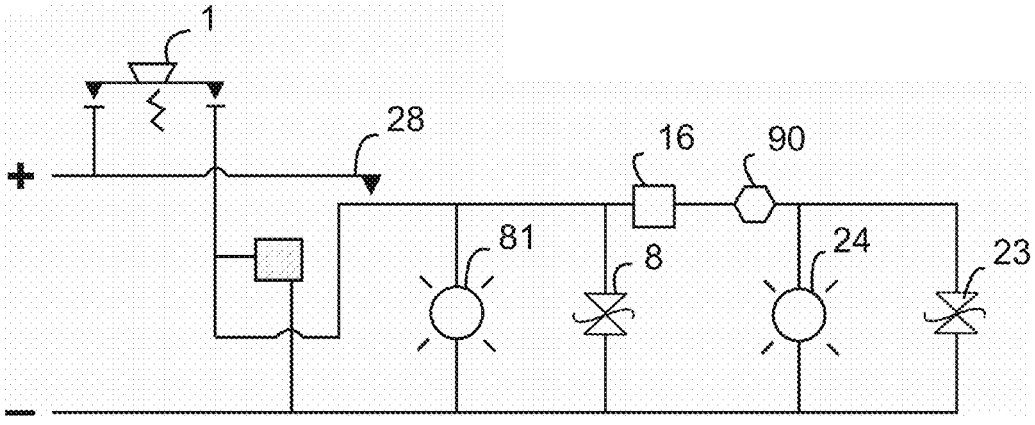
FIG. 2 is the electrical circuit of the present invention.

In FIG. 2, there is shown a partial wiring diagram for the vaporizer. It can be seen that the vaporizer has a main switch 1 that can be opened and closed. When the main switch is closed, the vaporizer is turned on and, when the main switch is opened, the vaporizer is turned off. The temperature sensor 90 is normally open but closed when the temperature reaches the operation temperature and opens when the temperature drops. The temperature sensor 90 will open when the draw on the vaporizer exceeds the capacity of the vaporizer or when the heating system of the water bath fails and also when temperature drops below the operating temperature. The first solenoid valve 8 operates an indicator light 81 when the valve is open. A second solenoid valve 23 is located in the outlet line. The second solenoid valve 23 located in the outlet line operates an indicator light 24 when the valve 23 is open. The sensor 90 opens and closes the second solenoid valve 23 of the outlet line.

In operation, the liquid fuel supply 10 has an outlet valve 2. The outlet valve of the fuel supply is opened when it is desired to operate the vaporizer. The main switch 28 is closed, thereby opening the first solenoid valve 8. Liquid fuel flows through the first pressure regulator 9, thereby reducing the pressure of the liquid fuel and enthalpy partially vaporizing the fuel. The partially vaporized liquid fuel flows into the coil 210 and ultimately out of the outlet 30 where part of the vaporized fuel is used to power the burner 410. The bath 400 is heated and the heating of the bath in turn heats the coil 210 causing all of the liquid fuel within the coil to vaporize before the fuel reaches the outlet 30.

The vapor for the start up the burner 400 is produced by the enthalpy and the residual ambient heat of the water bath.

If the fuel powered device requires more vapor than the vaporizer is able to produce, the temperature of the water will decrease. This causes that the temperature of the bath decrease as well. The temperature sensor 90 will cause the second solenoid 23 to close, thereby shutting down the outlet line 17. The bypass line 6 allows trapped gas to flow back to the supply tank 100.

In a typical operation, the pressure in the fuel supply tank is about 100 psig at an ambient temperature of 20° C. (the tank pressure varies with the ambient temperature). The regulator 9 cuts the pressure to about 35 to 50 psig. A small fraction of the liquid petroleum gas vaporizes and liquid temperature drops significantly, for example, the liquid petroleum temperature may drop to −20° C. at 35 psig. By reducing the pressure the enthalpy of the LPG vaporizes about 12% and the heat transferred from the bath to the coil vaporizes the balance of the liquid to vapor (gas). Once the vaporizer is started it supplies vapor/gas for the operation of the vaporizer. The temperature controller is set at a predetermined high temperature limit, preferably at about 85° C., but it can be set at other temperatures as well. The system will shut down if the temperature drops below a predetermined low temperature limit, preferably 65° C., which can also be set to any other temperature as well. By setting the temperature sensor and the controller on the bath, the system will not shut down prematurely, and can operate safely without interruptions.

The fuel powered device can be any suitable device that consumes fuel and is used outdoors. The vaporizer has to be located outdoors. If the vaporizer is supply gas to fuel burning devices indoors, the vaporizer has to be away from the building and the supply tank as per national and local codes. For example, propane burning devices include a joint match heater for asphalt, an asphalt patcher, a construction heater, an infrared burner and a grain dryer. Other fuel powered devices will be suitable as well. Liquid petroleum gases include propane, butane, isobutane, and ethane.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A vaporizer for a supply of fuel vapor to a fuel powered device, comprising:

a. a liquid petroleum gas (LPG) supply tank;

b. an immersed type vaporizing vessel comprising:

i. a heat exchange liquid;

ii. an LPG line immersed inside said heat exchanger liquid;

iii. a heating system to heat the heat exchanger liquid;

iv. an inlet port and an outlet port;

c. a liquid LPG supply line to carry the LPG from said supply tank to the inlet port of said vessel;

d. a vapor LPG line to carry a vapor LPG from said outlet port to said fuel powered device, and e. a temperature sensor to measure the temperature of said heat exchanger liquid, and a command system to shut off the vaporizer if the temperature of said heat exchanger liquid drops below a predefined temperature.

2. The vaporizer of claim 1, further having a first solenoid valve in the liquid supply line and a second solenoid valve in the vapor line, wherein said second solenoid valve is closed when the temperature of the exchanger liquid drops below a predetermined operating temperature and said second solenoid valve is opened when the temperature of the exchanger liquid goes above a predetermined operating temperature.

3. The vaporizer of claim 1, wherein said vapor supply line further having an oil trap to separate the oil from the vapor.

4. A method of vaporizing liquid petroleum gas (LPG), the method comprising:

a. using a vaporizer to vaporize a liquid LPG, wherein said vaporizer comprising of a LPG line immersed inside a temperature controlled liquid bath to heat the LPG;

b. using a controlled inlet line to supply the liquid LPG to the vaporizer;

c. using a controlled outlet line to remove vapor LPG out of the vaporizer;

d. continuously measuring and monitoring the temperature of the liquid bath; and e. shutting off the outlet of the vaporizer if the temperature of the liquid bath drops below a predetermined temperature.

5. The method of claim 4, wherein said vaporizer is shut off closing a first solenoid valve on the inlet line and a second solenoid valve on the outlet line.

6. The method of claim 4, wherein said predetermined temperature being 85° C.

7. The method of claim 4, wherein the liquid LPG is supplied from a liquid LPG tank.

8. The method of claim 4, wherein said bath being heated by a gas burning heater.

9. The method of claim 8, wherein said gas burning heater is ignited using a vaporized gas produced by a pressure drop across a pressure regulator installed on the LPG supply line.

* * * * *